US010593525B2

(12) United States Patent
Hock et al.

(10) Patent No.: US 10,593,525 B2
(45) Date of Patent: Mar. 17, 2020

(54) MASS ERROR CORRECTION DUE TO THERMAL DRIFT IN A TIME OF FLIGHT MASS SPECTROMETER

(71) Applicant: Thermo Fisher Scientific (Bremen) GmbH, Bremen (DE)

(72) Inventors: Christian Albrecht Hock, Bremen (DE); Hamish Stewart, Bremen (DE)

(73) Assignee: THERMO FISHER SCIENTIFIC (BREMEN) GMBH, Bremen (DE)

( * ) Notice: Subject to any disclaimer, the term of this patent is extended or adjusted under 35 U.S.C. 154(b) by 96 days.

(21) Appl. No.: 15/994,233

(22) Filed: May 31, 2018

(65) Prior Publication Data

US 2018/0350575 A1 Dec. 6, 2018

(30) Foreign Application Priority Data

Jun. 2, 2017 (GB) ..... 1708855
May 23, 2018 (GB) ..... 1808458.2

(51) Int. Cl.
*H01J 49/00* (2006.01)
*H01J 49/40* (2006.01)
*H01J 49/42* (2006.01)

(52) U.S. Cl.
CPC ..... *H01J 49/0009* (2013.01); *H01J 49/004* (2013.01); *H01J 49/0036* (2013.01); *H01J 49/40* (2013.01); *H01J 49/406* (2013.01); *H01J 49/425* (2013.01)

(58) Field of Classification Search
CPC ..... H01J 49/02; H01J 49/004; H01J 49/0009; H01J 49/10; H01J 49/34; H01J 49/40
See application file for complete search history.

(56) References Cited

U.S. PATENT DOCUMENTS

| | | | | |
|---|---|---|---|---|
| 6,049,077 | A | 4/2000 | Franzen | |
| 6,465,777 | B1 | 10/2002 | Rache | |
| 6,700,118 | B2 | 3/2004 | Yefchak et al. | |
| 6,797,947 | B2 | 9/2004 | Russ, IV et al. | |
| 6,998,607 | B1 | 2/2006 | Davis et al. | |
| 7,183,543 | B1 | 2/2007 | Overney et al. | |
| 2008/0087810 | A1 | 4/2008 | Gabeler | |
| 2008/0091370 | A1 | 4/2008 | Gabeler | |
| 2009/0048797 | A1* | 2/2009 | Tolmachev | H01J 49/0009 702/85 |
| 2018/0358215 | A1* | 12/2018 | Yamaguchi | G01N 27/62 |

FOREIGN PATENT DOCUMENTS

GB 2513463 A 10/2014

* cited by examiner

*Primary Examiner* — David E Smith
*Assistant Examiner* — Hsien C Tsai
(74) *Attorney, Agent, or Firm* — Charles B. Katz

(57) ABSTRACT

A method of calibrating a TOF-MS mass spectrum, to account for temperature changes, is disclosed. Ions are introduced into a Fourier Transform Mass Spectrometer and their mass to charge ratios are determined. Ions, including calibrant ions, are also introduced into a time of flight mass spectrometer and the mass to charge ratios of the calibrant ions at least are also determined. Specific peaks representative of calibrant ions are selected and matched between the TOF MS and FTMS spectra. The relative position of matched peaks in each spectrum is then used to determine a temperature correction factor for the TOF MS data, based upon the relative independence of the FTMS spectrum with respect to temperature.

21 Claims, 4 Drawing Sheets

MASS ERROR CORRECTION DUE TO THERMAL DRIFT IN A TIME OF FLIGHT MASS SPECTROMETER

FIELD OF THE INVENTION

This invention relates to a method and apparatus that adjusts the calibration function linking flight times to mass to charge (m/z) ratios in a Time of Flight mass spectrometer (TOF-MS). The calibration function changes over time to compensate for thermal drift.

BACKGROUND OF THE INVENTION

In time-of-flight (TOF) mass spectrometry, flight times of ions are measured to determine mass-to-charge (m/z) ratios. As is well known, the time of flight of an ion is proportional to the square root of its mass to charge ratio. The recorded time of detection is linked to the m/z ratio by a calibration function. The ambient temperature of a mass spectrometer can vary by more than 10 degrees Celsius during use, which leads to thermal expansion of the mechanical parts and thermally induced drift of the electronic components (voltage supplies). Variations in temperature of the TOF-MS lead to changes in the measured time of flight of ions of a given species. For a given calibration function, this leads to a negative effect on the accuracy of the calculated mass to charge ratio of that ion species, when conditions change after the initial calibration function has been determined.

Several approaches have been taken in the past to minimize these effects. In U.S. Pat. No. 6,049,077, a mix of appropriate materials is used in order to try to maintain a constant flight path as the temperature changes. A different solution has been proposed in U.S. Pat. No. 6,465,777, where the temperature of critical mechanical and electronic components is kept constant by the use of an air flow mechanism.

In U.S. Pat. No. 6,700,118, several sensors are employed to obtain temperature and strain measurements from the instrument. The measured parameters are then used in conjunction with a mathematical model to provide adjusted mass spectra.

Yet another approach is presented in US-A-2008/0087810. In this case, the length of the flight path is determined at a reference temperature of the assembly. Predetermined thermal expansion correction factors for the flight path assembly are then employed for correction. The correction is carried out by appropriately controlling another component of the TOF MS, such as the voltage applied to a power supply system, or a signal to control clock frequencies.

In U.S. Pat. No. 6,797,947, an internal calibration source is used to achieve high mass accuracy. So called lock mass ions with exactly know masses are mixed with analyte ions prior to mass analysis. The recorded mass spectrum contains peaks of known lock mass ions and analyte ions whose m/z ratio can be determined with high accuracy.

SUMMARY OF THE INVENTION

The present invention proposes an alternative approach to the problems with calibration function instability due to temperature variations, in a TOF-MS.

According to a first aspect of the present invention, there is provided a method of calibrating a TOF-MS mass spectrum, to account for temperature changes, as set out in claim 1. Software may also be provided to carry out that method.

The invention also extends to a system for calibrating a TOF-MS mass spectrum, to account for temperature changes, as set out in claim 14.

The mass accuracy of the high resolution output of a TOF-MS is (as discussed in the introduction above) susceptible to inaccuracies/drift as a consequence of a dependence of the time of flight of ions on temperature. Changes in the temperature result in shifts in mechanical and/or electronic components. The present invention is predicated upon the observation that, by contrast, the mass accuracy of Fourier Transform Mass spectrometers (FTMS) such as a Fourier Transform Ion Cyclotron Resonance spectrometer (FT-ICR MS) or an orbital trapping mass spectrometer such as Thermo Fisher Scientific, Inc.'s Orbitrap® is substantially unaffected by changes in temperature (and thus thermally induced shifts in the positioning of components thereof).

A mass spectrometry system according to the present invention comprises both TOF and FTMS mass spectrometers that are capable of analysis of the same analyte, either in parallel or sequentially. In one embodiment of the invention for calibration of the TOF MS, at least one FTMS set of data representative of the mass(es) of calibrant ion species is obtained, as well as at least one set of TOF-MS data representative of the mass(es) of those calibrant ion species. The calibrant ion species, briefly named calibrant ions, are a subset of the ions, which are supplied to the mass analyser of the TOF and FTMS mass spectrometer. The ions supplied to the mass analyser of both mass spectrometers may be the same or different. It is only important that the calibrant ions are supplied to the mass analyser of both mass spectrometers. The FTMS data set comprises data in the frequency domain having one or more peaks representing different ion species, one (or more) of which is chosen as the calibrant peak. The FTMS data set may be the raw frequency verses abundance data, or it may be a mass spectrum, that is, with the frequency converted to m/z. Likewise, the TOF MS data is, in preference, raw time of flight data, but may be a mass spectrum of m/z versus abundance.

A suitable peak or several peaks are chosen in the set of data generated by one of the FTMS and the TOF MS. Analyte peaks (that is, peaks representing ions within a sample that has been introduced) or background peaks (that is, peaks representative of, for example, carrier gas ions used to introduce the sample ions into the mass spectrometer) can be used. A preferable number of ion species (peaks) to be used for calibration of the TOF may be between 1 and 10. The choice of peak is based upon ease of matching in the TOF MS and FTMS data, as discussed further below. In preference, the peak or peaks that is/are chosen are in the FTMS data.

The m/z ratios of ion species used for calibrations are hereafter referred to as the calibrant masses, and the corresponding peaks in the FTMS and TOF data representative of mass to charge ratios are referred to as calibrant peaks.

Once the peak or peaks have been chosen, preferably in the FTMS data, the corresponding peak or peaks in the other device (in preference, in the TOF MS data) are searched to find the matching peak(s) therein. In particular, in preferred embodiments, the TOF MS data is searched or scanned to locate that or those peak(s) which are generated by the same calibrant ion species as was chosen as the calibrant ion species in the FTMS data. Changes in temperature cause the time of flight of the ions in the TOF to shift, which in turn results in a shift in the position of the peak(s) in the TOF MS data relative to the position(s) of the corresponding peaks in the FTMS data (which are essentially temperature independent). As the position of the TOF MS data peak(s) shifts, a temperature correction factor can then be determined based upon that shift.

The calibrant masses m[i] are preferably determined from the positions of the FTMS calibrant peaks, using one (or more) of a plurality of techniques known in the art of FTMS. For example, the measured times of flight $t_m$ may be identified in the TOF mass spectrometer as centroids of corresponding TOF calibrant peaks. The measured time of flight $t_m$ of ions in a TOF MS is, as is well known, related to the square root of the mass to charge ratio m/z of the ions via a proportionality constant, A. Timing delays in the data acquisition electronics also introduce a timing offset, $t_0$. As a formula, $m/z=A(t_m-t_0)^2$. Preferably, the temperature correction factor generated in accordance with the present invention is used to adjust the constant A and/or $t_m$ so that the correct mass is calculated as the actual time of flight of ions of a specific species changes with temperature. However it is to be understood that it is not essential to apply the temperature correction factor as a correction to the time of flight to mass to charge calibration function. It is equally possible to determine a calibration function (for example, during start up of the mass spectrometer) and to leave that calibration function with fixed parameters even as temperature drifts. In that case, the temperature correction factor can be applied to the uncorrected mass data to adjust for the temperature shift.

Because of the high operation rate of the TOF (hundreds of mass spectra per second), only a very small fraction of the total analysis time of the TOF needs to be set aside for obtaining suitable data to obtain the temperature correction factor.

Various workflows are contemplated. In one optional embodiment, an MS1 (precursor) scan of a sample eluted from a liquid chromatograph, for example, is carried out in the FTMS to detect all peaks in that sample. Precursor sample ions from the same eluted chromatographic peak are then injected into the TOF, where they are detected. The resultant FTMS data representative of the mass(es) of calibrant ion species can be used to calibrate the TOF MS data. In this scenario, precursor sample ions are injected into the TOF promptly after precursor sample ions are injected into the FTMS.

In an alternative arrangement, MS1 analysis by the FTMS is carried out. However, sample precursor ions (from the same chromatographic peak are then fragmented using a collision cell or the like, and the resulting fragment ions are injected into the TOF. Data representative of the fragment masses (MS2 data) may then be obtained. Calibration of the TOF MS may be achieved by identifying peaks in the MS2 data generated by the TOF MS which arise from unfragmented precursor ions. These may be compared with the position of the corresponding peaks in the precursor MS1 scan obtained by the FTMS.

In the case that no suitable precursor peaks can be identified in the MS2 scan obtained by the TOF MS, fragment ions generated by the collision cell or the like may be sent back to the FTMS for the generation of MS2 data representative of fragment masses by the FTMS. Then suitable peaks in the MS2 scan obtained by the FTMS can be cross correlated with corresponding peaks in the MS2 data obtained by the TOF MS.

Herein, the terms "resolution" and "resolving power" are employed. The resolution is the difference in the mass to charge ratio m/z of two peaks Δm/z for which the two peaks can be separated in the mass spectrum. Accordingly the resolving power R of the mass analyser is defined for a peak having a mass to charge ratio m/z by the ratio:

$$R(m/z) = \frac{m/z}{\Delta m/z}$$

For the purposes of the present discussion, the resolving power R assumes that two peaks should be separated at the half maximum height of a peak (the 50% criterion, as distinct from stricter criteria such as the width across the lowest 10% of each peak). Then, the resolution Δm/z is the FWHM (full width at half maximum) of the peak. Accordingly, the resolving power R of the mass analyser is then given by:

$$R(m/z) = \frac{m/z}{FWHM}$$

In general terms, it is desirable that the resolving power of the TOF mass analyser is sufficient to ensure that the peak shift caused by temperature variations is smaller than the peak width of any calibrant ion peak chosen. For a given TOF MS resolving power, this may be manifested as a selection criterion for potential calibrant peaks in the FTMS mass spectrum. Looked at another way, the resolving power of the TOF MS may be specified as no less than a minimum threshold, if a sufficient number of suitable calibrant peaks are to be identified and used successfully to generate a calibration function.

Preferably, ions may be trapped (eg in a trapping device such as a linear ion trap) and accumulated over multiple cycles. The trapping may take place immediately upstream of the TOF MS and/or the FTMS device(s). This allows additional precursor ions and, for example, A+1 or A+2 isotopes to be added to the ion species that are injected into each analyser, to improve the calibration.

Whilst a single set of FTMS data representative of the mass(es) of the calibrant ion species may be employed to calibrate the TOF MS data, multiple cycles can instead be employed, and a statistical analysis carried out to provide a still further improved temperature correction factor.

Typically the resolving power of the FTMS is higher than the resolving power of the TOF MS. It is accordingly preferred that a candidate peak or peaks is identified in the FTMS data and matched in the TOF MS data. However this is not essential. A candidate peak or peaks can instead be identified in the TOF MS data, and then matched in the FTMS data.

Various other preferred features of the present invention will be apparent from the appended claims and from the following specific description of some preferred embodiments.

BRIEF DESCRIPTION OF THE DRAWINGS

The invention may be put into practice in a number of ways and some embodiments will now be described by way of example only and with reference to the accompanying figures in which.

DETAILED DESCRIPTION OF PREFERRED EMBODIMENTS

Herein the term mass may be used to refer to the mass-to-charge ratio, m/z.

Figure 1:
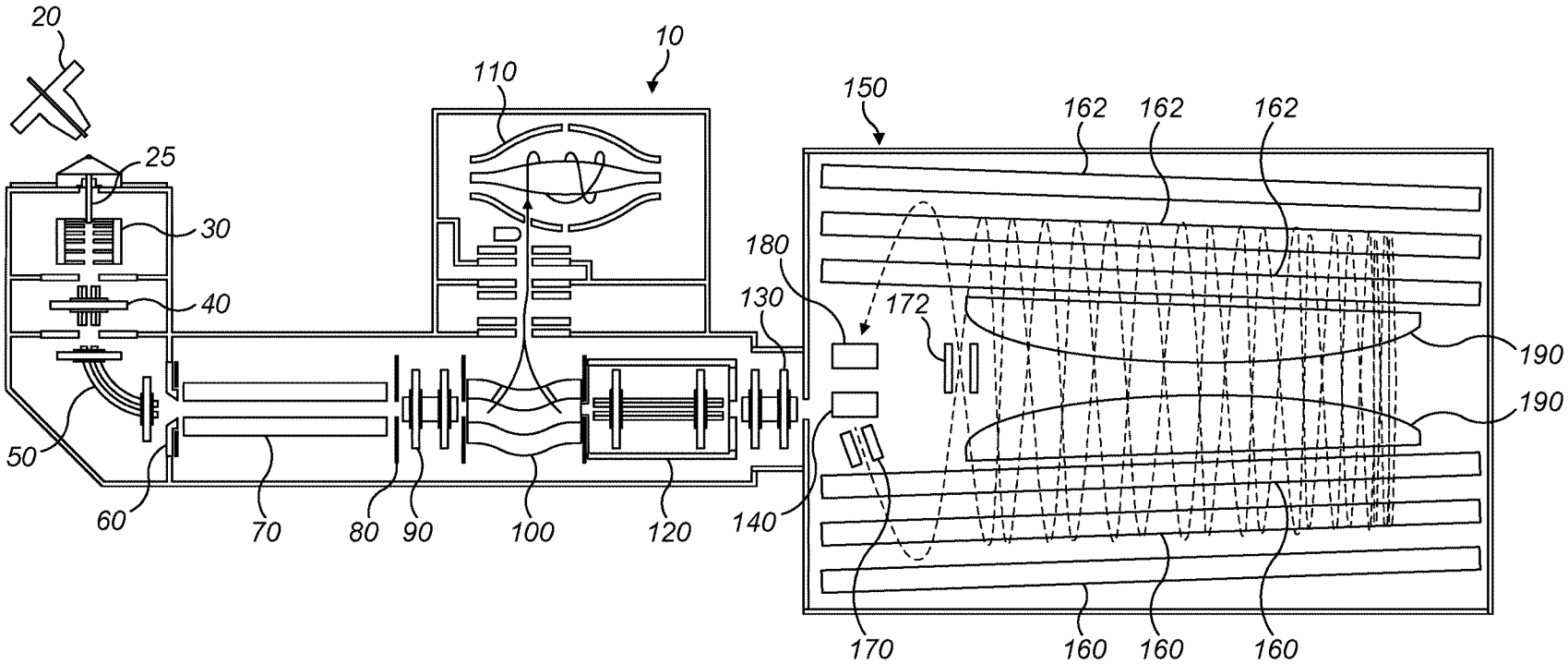
FIG. 1 shows a schematic layout of a mass spectrometer including a Fourier Transform Mass Analyser and a Time of Flight mass Analyser, and representing a first embodiment of the present invention.

FIG. 1 shows a schematic arrangement of a mass spectrometer 10 suitable for carrying out methods in accordance with embodiments of the present invention.

In FIG. 1, a sample to be analysed is supplied (for example from an autosampler) to a chromatographic apparatus such as a liquid chromatography (LC) column (not shown in FIG. 1). One such example of an LC column is the Thermo Fisher Scientific, Inc ProSwift monolithic column which offers high performance liquid chromatography (HPLC) through the forcing of the sample carried in a mobile phase under high pressure through a stationary phase of irregularly or spherically shaped particles constituting the stationary phase. In the HPLC column, sample molecules elute at different rates according to their degree of interaction with the stationary phase.

A chromatograph may be produced by measuring over time the quantity of sample molecules which elute from the HPLC column using a detector (for example a mass spectrometer). Sample molecules which elute from the HPLC column will be detected as a peak above a baseline measurement on the chromatograph. Where different sample molecules have different elution rates, a plurality of peaks on the chromatograph may be detected. Preferably, individual sample peaks are separated in time from other peaks in the chromatogram such that different sample molecules do not interfere with each other.

In a chromatograph, a presence of a chromatographic peak corresponds to a time period over which the sample molecules are present at the detector. As such, a width of a chromatographic peak is equivalent to a time period over which the sample molecules are present at a detector. Preferably, a chromatographic peak has a Gaussian shaped profile, or can be assumed to have a Gaussian shaped profile. Accordingly, a width of the chromatographic peak can be determined based on a number of standard deviations calculated from the peak. For example, a peak width may be calculated based on 4 standard deviations of a chromatographic peak. Alternatively, a peak width may be calculated based on the width at half the maximum height of the peak. Other methods for determining the peak width known in the art may also be suitable.

The sample molecules thus separated via liquid chromatography are then ionized using an electrospray ionization source (ESI source) 20 which is at atmospheric pressure.

Sample ions then enter a vacuum chamber of the mass spectrometer 10 and are directed by a capillary 25 into an RF-only S lens 30. The ions are focused by the S lens 30 into an injection flatapole 40 which injects the ions into a bent flatapole 50 with an axial field. The bent flatapole 50 guides (charged) ions along a curved path through it whilst unwanted neutral molecules such as entrained solvent molecules are not guided along the curved path and are lost.

An ion gate (TK lens) 60 is located at the distal end of the bent flatapole 50 and controls the passage of the ions from the bent flatapole 50 into a downstream quadrupole mass filter 70. The quadrupole mass filter 70 is typically but not necessarily segmented and serves as a band pass filter, allowing passage of a selected mass number or limited mass range whilst excluding ions of other mass to charge ratios (m/z). The mass filter can also be operated in an RF-only mode in which it is not mass selective, i.e. it transmits substantially all m/z ions. For example, the quadrupole mass filter 70 may be controlled by the controller 130 to select a range of mass to charge ratios to pass of the precursor ions which are allowed to mass, whilst the other ions in the precursor ion stream are filtered.

Although a quadrupole mass filter is shown in FIG. 1, the skilled person will appreciate that other types of mass selection devices may also be suitable for selecting precursor ions within the mass range of interest. For example, an ion separator as described in US-A-2015287585, an ion trap as described in WO-A-2013076307, an ion mobility separator as described in US-A-2012256083, an ion gate mass selection device as described in WO-A-2012175517, or a charged particle trap as described in U.S. Pat. No. 799,223, the contents of which are hereby incorporated by reference in their entirety. The skilled person will appreciate that other methods selecting precursor ions according to ion mobility, differential mobility and/or transverse modulation may also be suitable.

Ions then pass through a quadrupole exit lens/split lens arrangement 80 and into a first transfer multipole 90. The first transfer multipole 90 guides the mass filtered ions from the quadrupole mass filter 70 into a curved trap (C-trap) 100. The C-trap (first ion trap) 100 has longitudinally extending, curved electrodes which are supplied with RF voltages and end caps that to which DC voltages are supplied. The result is a potential well that extends along the curved longitudinal axis of the C-trap 100. In a first mode of operation, the DC end cap voltages are set on the C-trap so that ions arriving from the first transfer multipole 90 are captured in the potential well of the C-trap 100, where they are cooled. The injection time (IT) of the ions into the C-trap determines the number of ions (ion population) that is subsequently ejected from the C-trap into the mass analyser.

Cooled ions reside in a cloud towards the bottom of the potential well and are then ejected orthogonally from the C-trap towards the first mass analyser 110.

As shown in FIG. 1, the first mass analyser is a Fourier Transform Mass Analyser (FTMS) 110, for example the Orbitrap® orbital trapping mass analyser sold by Thermo Fisher Scientific, Inc. and described, for example, in WO-A-96/30930. The FTMS 110 has an off centre injection aperture and the ions are injected into the FTMS 110 as coherent packets, through the off centre injection aperture. Ions are then trapped within the orbital trapping mass analyser by a hyperlogarithmic electric field, and undergo back and forth motion in a longitudinal direction whilst orbiting around the inner electrode.

The axial (z) component of the movement of the ion packets in the orbital trapping mass analyser is (more or less) defined as simple harmonic motion, with the angular frequency in the z direction being related to the square root of the mass to charge ratio of a given ion species. Thus, over time, ions separate in accordance with their mass to charge ratio.

Ions in the FTMS are detected by use of an image detector (not shown) which produces a "transient" in the time domain containing information on all of the ion species as they pass the image detector. The transient is then subjected to a Fast Fourier Transform (FFT) resulting in a series of peaks in the frequency domain. From these peaks, a mass spectrum, representing abundance/ion intensity versus m/z, can be produced.

Although FIG. 1 shows an FTMS 110 in which ions are trapped axially and radially by an electrostatic field, it will be understood that other forms of FTMS are contemplated, such as, for example, a Fourier transform ion cyclotron resonance (FT-ICR) mass analyser in which ions are trapped axially by an electrostatic field whilst radial and azimuthal trapping is achieved by the application of a magnetic field. The primary requirement of the FTMS 110 is that its output (that is, the position and shape of peaks in a mass spectrum it generates) should be relatively stable with respect to short and long term shifts in temperature.

In the configuration described above, the sample ions (more specifically, a mass range segment of the sample ions within a mass range of interest, selected by the quadrupole mass filter) are analysed by the orbital trapping mass analyser without fragmentation. The resulting precursor mass spectrum is denoted MS1.

In a second mode of operation of the C-trap 100, ions passing through the quadrupole exit lens/split lens arrangement 80 and first transfer multipole 90 into the C-trap 100 may also continue their path through the C-trap and into the fragmentation chamber 120. As such, the C-trap effectively operates as an ion guide in the second mode of operation. Alternatively, cooled ions in the C-trap 100 may be ejected from the C-trap in an axial direction into the fragmentation chamber 120. The fragmentation chamber 120 is, in the mass spectrometer 10 of FIG. 1, a higher energy collisional dissociation (HCD) device to which a collision gas may be supplied. Precursor ions arriving into the fragmentation chamber 120 are thus, in one mode of operation of the fragmentation chamber 120, bombarded with high energy collision gas molecules resulting in fragmentation of the precursor ions into fragment ions. Substantially all of the precursor ions may be fragmented. However, as will be explained in further detail below, in accordance with some preferred embodiments of the invention, the energy of the collision gas molecules is set so that at least some of the precursor ions pass through the fragmentation chamber 120 without being collisionally dissociated.

In an alternative mode of operation of the fragmentation chamber 120, however, the precursor ions are not subjected to a collision gas, or the energy of the collision gas that is supplied to the fragmentation chamber is insufficient to fragment the precursor ions. Thus, the fragmentation chamber 120 in this alternative mode of operation acts as an ion guide for the precursor ions.

Although an HCD fragmentation chamber 120 is shown in FIG. 1, other fragmentation devices may be employed instead, employing such methods as collision induced dissociation (CID), electron capture dissociation (ECD), electron transfer dissociation (ETD), photodissociation, and so forth.

Ions (either partially fragmented or unfragmented) may be ejected from the fragmentation chamber 120 at the opposing axial end to the C-trap 100. The ejected ions pass into a second transfer multipole 130. The second transfer multipole 130 guides the ions from the fragmentation chamber 120 into an extraction trap (second ion trap) 140. The extraction trap 140 trap is a radio frequency voltage controlled trap containing a buffer gas. For example, a suitable buffer gas is argon at a pressure in the range 5×10−4 mBar to 1×10−2 mBar. The extraction trap has the ability to quickly switch off the applied RF voltage and apply a DC voltage to extract the trapped ions. A suitable flat plate extraction trap is further described in U.S. Pat. No. 9,548,195 (B2). Alternatively, a C-trap may also be suitable for use as a second ion trap.

The extraction trap 140 is provided to accumulate ions ejected from the fragmentation chamber 120, prior to injection of these ions into the time of flight mass analyser 150. In FIG. 1, the time of flight mass analyser 150 shown is a multiple reflection time of flight mass analyser (mr-TOF) 150.

The mr-TOF 150 is constructed around two opposing ion mirrors 160, 162, elongated in a drift direction. The extraction trap 140 injects ions into the first mirror 160 and the ions then oscillate between the two mirrors 160, 162. The angle of ejection of ions from the extraction trap 140 and additional deflectors 170, 172 allow control of the energy of the ions in the drift direction, such that ions are directed down the length of the mirrors 160, 162 as they oscillate, producing a zig-zag trajectory. The mirrors 160, 162 themselves are tilted relative to one another, producing a potential gradient that retards the ions' drift velocity and causes them to be reflected back in the drift dimension and focused onto a detector 180. The tilting of the opposing mirrors would normally have the negative side-effect of changing the time period of ion oscillations as they travel down the drift dimension, making achievement of a good ion time-focus impossible. This is corrected with a stripe electrode 190 that alters the flight potential for a portion of the inter-mirror space, varying down the length of the opposing mirrors 160, 162. The combination of the varying width of the stripe electrode 190 and variation of the distance between the mirrors 160, 162 allows the reflection and spatial focusing of ions onto the detector 180 as well as maintaining a good time focus. A suitable mr-TOF 150 for use in the present invention is further described in U.S. Pat. No. 9,136,101. Of course, other mr-TOFs might be employed, such as those described in GB-A-2,080,021 to Wollnik, WO-A-2005/001878 to Verentchikov, US-A-2011/0168880 to Ristroff, the spiral TOF arrangement of U.S. Pat. No. 7,504,620 to Jeol, U.S. Pat. No. 8,637,815 to Makarov and Giannakopulos, and U.S. Pat. No. 8,395,115, U.S. Pat. No. 8,674,293, U.S. Pat. No. 9,082,605, and U.S. Pat. No. 9,324,553, all to Makarov and Grinfield. It is thus to be understood that the description of a specific mr-TOF mass spectrometer herein is merely for the purposes of illustration and is in no way intended to be limiting. Indeed, although the use of a multi reflection time of flight mass spectrometer confers certain advantages, the inventive concepts described and claimed are equally applicable to any form of time of flight mass spectrometer and the claims are to be construed accordingly.

Ions arriving at the detector 180 of the mr-TOF are used to construct a mass spectrum, because, as is well known, the time of flight of ions through the mr-TOF is related to the mass to charge ratio m/z. In the second mode of operation of the fragmentation chamber 120, the ions entering the mr-TOF 150 are unfragmented so that the resulting mass spectrum is an MS1 mass spectrum. In the first mode of operation of the fragmentation chamber 120, however, the mass spectrum contains fragment ions and may be denoted MS2.

Although the foregoing describes the use of an extraction trap 140 to allow accumulation of ions over multiple cycles prior to injection into the mr-TOF 150, it will be understood that this is advantageous but not essential for the implementation of the method in accordance with the invention.

The mass spectrometer 10 is under the overall control of a system controller 200. The system controller 200 is, in general terms, configured to receive and process the data generated by the FTMS 110 and the mr-TOF 150, and generate a modified calibration function for the mr-TOF, based upon a comparison between the FTMS and mr-TOF data, which takes into account changes in the time of flight of ions in the TOF as the temperature drifts. The determined modified calibration function can then be applied to subsequently obtained mr-TOF data in order to correct these data for changes in temperature in the system and in particular in the mr-TOF. The system controller 200 may be implemented in software, hardware or both. Moreover, the FTMS 110 and the mr-TOF may each have their own associated processors, for capturing the raw data from the image detector of the FTMS 110 and the mr-TOF detector 180, and generating FTMS and mr-TOF mass spectra respectively. Alternatively, a single processor may be employed to carry out the Fast Fourier transform of the transient data obtained by the image detector of the FTMS 110 and to convert the abundance vs time of arrival data from the detector 180 into a mass spectrum as well.

The system controller 200 may be physically and/or logically separated from this or these processors. In that case, the system controller may not (in contrast with the arrangement shown in FIG. 1) be local to the mass spectrometer 10. The data obtained from the FTMS 110 and the mr-TOF 150 could, for example, be obtained locally to the mass spectrometer, and then sent by a wired or wireless communicated to the system controller 200 which may be formed as software operating on a local or remote personal computer (PC). Thus it is to be understood that, whilst the system controller 200 forms a logical part of the mass spectrometer 10, in terms of its defined function, it need not necessarily form a physical part of it. That said, in practical terms, and to optimise speed of calibration and recalibration, it is preferable that the system controller 200 is formed as a part of the hardware or software of the local operating system of the mass spectrometer 10.

As noted in the background section, mass spectra generated by the mr-TOF are particularly susceptible to fluctuations in temperature, resulting in movement (expansion or contraction), of mechanical components and/or variations in electrical components. The output of the FTMS 110 is by contrast relatively unaffected by such temperature variations.

Thus the system controller 200 uses data from the FTMS as a basis for correcting temperature based shifts in the position of peaks in the mr-TOF data. A number of different examples of ways in which this might be done will now be set out.

(i) Use of Precursor Ions Only

Here, during a first time period, precursor ions are accumulated into the C-trap 100 and then injected into the FTMS 110 so as to generate an MS1 mass spectrum. Once precursor ions have been ejected from the C-trap into the FTMS 110, the C-trap 110 is switched, during a second time period, so as to allow precursor ions to pass through axially towards the fragmentation chamber 120. The fragmentation chamber 120 itself is operated in ion guide mode during that second time period, so that substantially no fragmentation of the precursor ions takes place. The precursor ions then enter the mr-TOF 150 and their times of flight are detected in known manner. The system controller 200 (or the processor associated with the mr-TOF as described above) is programmed with an initial calibration function that converts the raw time of flight data collected by the mr-TOF into a mass spectrum. The initial calibration function may be obtained during initial start-up and calibration of the mass spectrometer 10, or otherwise. Suitable (but of course non limiting) techniques for converting times of flight into m/z are described above.

Preferably the first and second time periods, and the switching duration between the two, are rapid enough that precursor ions are captured and analysed by the FTMS 110 and the mr-TOF 150 from the same chromatographic peak. Once an MS1 from the FTMS 110 and an MS1 from the mr-TOF 150 have been generated, the system controller 200 then looks for characteristic peaks in the MS1 of the FTMS 110. Characteristic peaks have to be chosen, which can be distinctly identified in both mass spectra, MS1 from the FTMS 110 and an MS1 from the mr-TOF 150. Preferably characteristic peaks are single peaks and not double peaks (representing interfering ion species/isotopes etc). It is particular desirable that characteristic peaks in the FTMS mass spectrum are single peaks at the resolving power of the FTMS 110. It is further preferred that to a characteristic peak is chosen by the criteria, that no other peaks can be observed in the mass spectrum of the FTMS 110 in a mass range near to the characteristic peak. Preferably the mass range is defined by the requirement, that due to this mass range it is guaranteed that the characteristic peak is also a single peak in the mass spectrum of mr-TOF though it has a lower resolving power, which can be distinctly identified. A single characteristic peak may suffice, or alternatively a plurality of peaks may be employed. These peaks may be isolated (that is, the characteristic peaks may be separated by one or more other peaks which are not used for calibration purposes). Alternatively, groups of peaks in the FTMS MS1 mass spectrum may be employed as characteristic peaks.

These peaks are henceforth referred to as "calibrant peaks". Their mass to charge ratio is apparent from the mass spectrum. Usually the ion species responsible for the calibrant peak(s) are identifiable as a consequence. However this is not essential: as long as the mass to charge ratio of the selected calibrant peak is known, this is sufficient to allow subsequent calibration of the mr-TOF mass spectrum as described below.

The term "calibrant peak" is meant in its most general sense, to identify those peaks in the FTMS mass spectrum that the system controller 200 will use for calibration purposes. Sample ion species that generate a suitable peak (the issue of suitability is discussed below) may be employed as a calibrant peak or peaks. In other embodiments, the peak or peaks chosen (selected) for calibration purposes may arise from ion species that are present alongside the sample ions. For example, background ion species that are present (for example, ions resulting from organic solvents used to carry the sample into the mass spectrometer) might generate a peak or peaks suitable for use as a calibrant peak.

Thus it will be understood that embodiments of the present invention allow for improved mass accuracy of the TOF MS mass spectrum, without the need directly to inject "lock masses" of accurately known m/z to calibrate the TOF MS directly. All that is necessary is that a peak (or peaks) is chosen in a first of the FTMS/TOF MS mass spectra, and the corresponding peak then identified in the other of the FTMS/TOF MS mass spectra. It is not necessary actually to identify the ion species that causes the peak.

Various criteria may be employed to identify suitable peaks in the FTMS mass spectrum, such as one or more of the signal to noise ratio, the peak shape, and the peak quality. See for example Cox et al, J Am Soc Mass Spectrom. 2009 August; 20(8):1477-85. doi: 10.1016/j.jasms.2009.05.007. Epub 2009 May 20 "Computational principles of determining and improving mass precision and accuracy for proteome measurements in an Orbitrap", and Gorshkov et al, J Am Soc Mass Spectrom. 2010 November; 21(11):1846-51. doi: 10.1016/j.jasms.2010.06.021. Epub 2010 Jul. 7.

Having identified the calibrant peak or peaks in the FTMS mass spectrum, the centroid of each, and the associated quality factor, is stored by the system controller 200. As part of this step, space charge effects in the FTMS may be accounted for.

Next, the system controller 200 searches the mr-TOF mass spectrum for corresponding peaks. Best fit algorithms can, for example, be employed. The purpose of the method described herein is to calibrate the mr-TOF using the FTMS mass spectrum. Thus it is anticipated that there will be at least some shift in the measured position of a peak in the mr-TOF mass spectrum relative to the measured position of the same peak in the FTMS mass spectrum. However, further constraints can be placed upon the system controller search of the mr-TOF mass spectrum. For example, the system controller 200 may be configured to consider only those peaks in the mr-TOF mass spectrum, that are within a limited mass range of the potentially corresponding peak in the FTMS mass spectrum. Moreover, the amount of shift in the position of the mass peak may (in absolute terms, ie, amu) be dependent upon the m/z of the calibrant peak itself, that is to say, ions of a first m/z may experience a greater or lesser positional shift in the mr-TOF mass spectrum, relative to the FTMS mass spectrum, than ions of a second, different m/z. In consequence, the maximum m/z shift constraint for corresponding peaks may be non-constant across the mass spectra.

Once the peak or peaks in the mr-TOF mass spectrum has/have been identified, the system controller determines a modified calibration function for converting times of flight to m/z, based upon the amount of peak shift between the mr-TOF and FTMS calibrant peaks. Specifically, the system controller 200 treats the position of the FTMS peak or peaks as having been unaffected by temperature changes, and then calculates a correction factor to be applied to the mr-TOF data to correct for changes in time of flight resulting from temperature drifts. In the preferred embodiment, the correction factor is manifested as an adjustment to the parameters of the calibration function used to convert the raw time of flight data into a mass spectrum.

The measured time of flight $t_m$ of ions in a TOF MS is, as is well known, related to the square root of the mass to charge ratio m/z of the ions via a proportionality constant, A. Timing delays in the data acquisition electronics also introduce a timing offset, $t_0$. As a formula, $m/z=A(t_m-t_0)^2$. In a most straightforward example, the system controller 200 may seek a single calibrant peak (or a single group of adjacent peaks, as discussed above) in the FTMS and a single corresponding peak or peak group in the mr-TOF mass spectrum. It may then determine, from the shift between the peak position in the mr-TOF and the FTMS, a single, constant correction factor (essentially, a scalar multiplier) that is then used to adjust the proportionality constant A and/or the timing offset to that relates the measured times of flight of the ions in the TOF MS, to their mass to charge ratios. When the temperature correction factor is first determined, it is applied to the initial calibration function determined upon, for example, start-up of the mass spectrometer so that the proportionality constant A is modified to A' and/or the time offset $t_0$ is modified to $t_0'$, in the calibration function given as an example above. That modified calibration function can then be applied to the TOF data to produce temperature corrected mass spectra. The process can be repeated at intervals (eg at fixed time intervals, after a certain number of cycles of analysis, etc) and the calibration function updated after a new temperature correction factor is identified (so that, in the example above, A' is modified to A" and then to A''' etc, whilst $t_0'$ is modified to $t_0''$ and then to $t_0'''$ etc).

Alternatively, a plurality of mass peaks located across the range of the FTMS mass spectrum may be used as the calibrant peaks. A corresponding plurality of mass peaks is then identified in the mr-TOF mass spectrum, and the temperature correction factor/modified time of flight to m/z calibration function can be determined by a comparison of each of the corresponding peaks. As noted above, the absolute amount of peak shift may vary across the mass range analysed in the FTMS and mr-TOF mass spectra. Thus, although a single constant correction factor could still be obtained in that case (for example, by calculating a mean of the different peak shifts across the m/z range), preferably in that case a non-constant temperature correction factor is determined instead, and applied to the time of flight to m/z conversion formula, for example by modifying the proportionality constant and any time offsets, but also by for example adding in higher order terms to account for any non-linear shifts in time of flight across the mass range. Most simply, linear interpolation between the measured calibrant peak mass shifts can be employed. Alternatively, a curve fitting algorithm can be employed. In the preferred embodiment, the centroids and quality factors stored by the system controller 200 in respect of the calibrant peaks of the FTMS mass spectrum are employed for the calibration of the mr-TOF mass spectrum. During fitting, outliers can be identified when comparing, for example, the $R^2$ of the different fits.

During the calibration quality factors of the calibrant peaks can be used in the following manner to optimise the calibration result:

Calibrant peaks having a higher intensity are heigher weighted.

Calibrant peaks being single peaks in the mr-TOR mass spectrum are heigher weighted.

Calibrant peaks fully resolved in the mr-TOR mass spectrum are heigher weighted.

Only a specific number n of calibrant peaks having the highest intensity in the FTMS and/or mr-TOR mass spectrum are used for the calibration.

Only calibrant peaks being single peaks in the mr-TOR mass spectrum are used for the calibration.

Only calibrant peaks fully resolved in the mr-TOR mass spectrum are used for the calibration.

This list of criteria is not limited, but addressed preferred criteria. One criterion can be used alone or some criteria can be used together to further improve the quality of the calibration.

The criteria can be used depending on the investigated samples. E.g. the exclusive use of calibrant peaks being single peaks is preferred if there are sufficient such peaks in a mr-TOF mass spectrum of a sample, so such other more complex peaks are not required for the calibration.

The number of used calibration peaks might also depend on the before mentioned criteria. Higher-quality single peaks will reduce the number of calibration peaks that are employed to achieve acceptable performance, and conversely lower-quality single peaks will necessitate the use of a relatively greater number of calibration peaks.

If the peak structure of the observed mass spectra varies with the time, which related to the experiment supplying the investigated sample to the FTMS and TOF MS e.g. due a chromatography process by which the sample is supplied, the used calibrant peaks may vary with the time. In particular the criteria to choose the calibration peaks and/or the number of used calibration peaks may vary be the time. This variation is done in that way, that the temperation correction factors for all measured TOF MS data is always provided in an appropriate manner.

In a preferred embodiment of the invention, in particular when a steady temperature drift of a TOF mass spectrometer is expected, a detailed calibration is performed only for a detected TOF mass spectrum at a specific time repeated in a specific time period and a rough calibration is done at the interim time using only one or a small number of calibrant peaks. Preferably for this the most relevant calibrant peaks are used, e.g. peaks having the highest intensity and/or best resolution. This is reducing the effort to do the calibration and secures on the other hand a stable control of a temperature drift, in particular of a linear temperature drift, which for example might be induced by a heating effect of a component of the TOF mass spectrometer.

It is anticipated that the temperature dependence of the TOF MS mass spectrum can be largely corrected simply by adjusting the proportionality constant A in the formula identified above. However for higher levels of mass accuracy in the TOF MS mass spectrum, further corrections can be employed: for example, the timing offset to may be considered and different proportionality constant A' can be employed. Higher order terms can be added to the m/z to time of flight formula eg $m/z=A'(t_m-t_0)^2+A''t_m+A'''$ and so forth.

Further discussion of the conversion of times of flight into mass to charge ratios in a TOF MS may be found for example in "Improved Calibration of Time-of-Flight Mass Spectra by Simplex Optimization of Electrostatic Ion Calculations", Christian et al, Anal. Chem. 2000, 72, pages 3327-3337.

Figure 2:
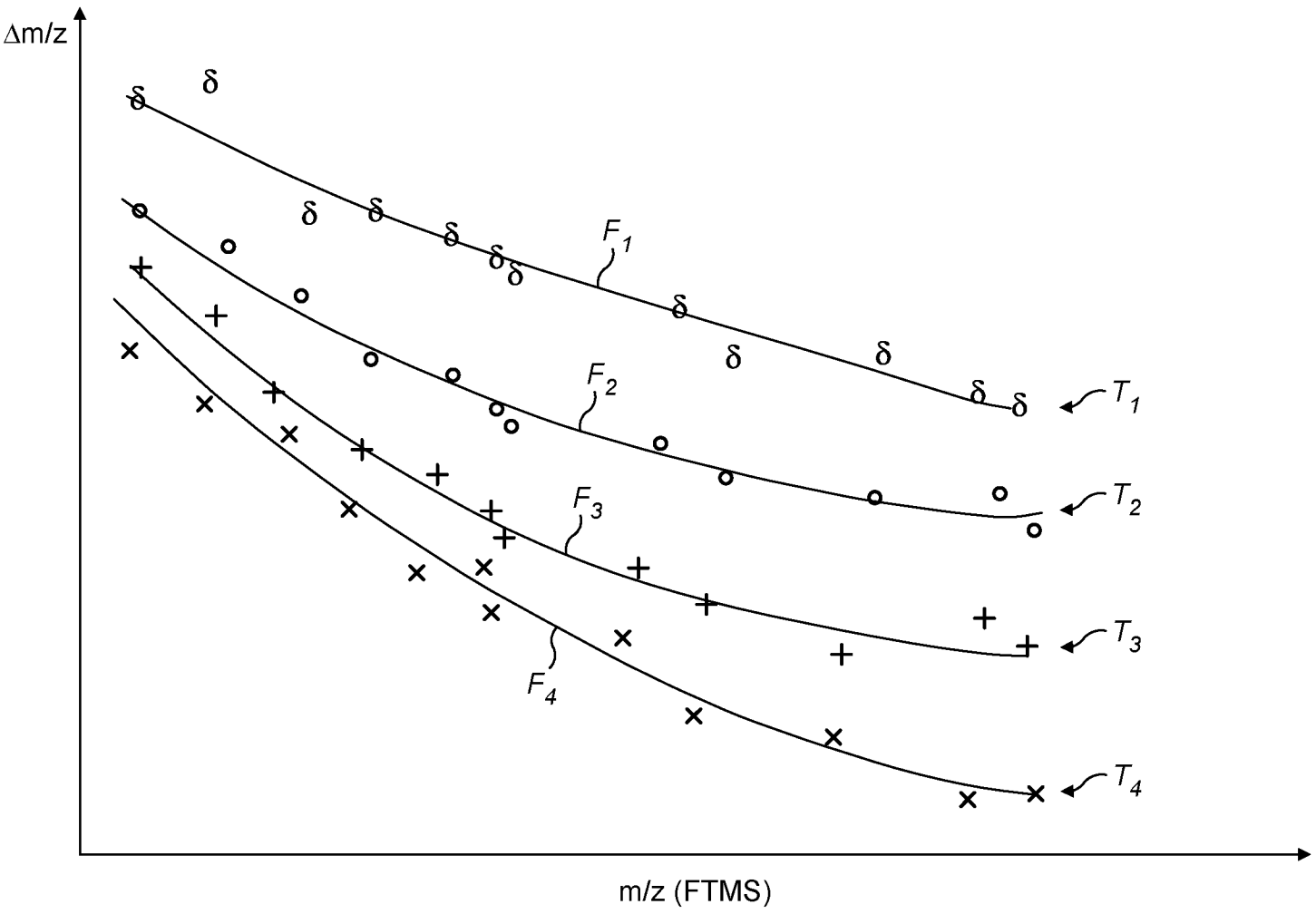
FIG. 2 shows a series of calibration functions for temperature correction of a mass spectrum generated by the Time of Flight mass analyser of FIG. 1, at a range of different temperatures.

FIG. 2 shows plots of mass shift (that is, the difference between the peak position as measured in the mr-TOF mass spectrum, and the peak position as measured in the FTMS mass spectrum) against mass number m/z as determined in the FTMS mass spectrum. It is to be understood that the curves and data points in FIG. 2 are merely to allow a better understanding of the principles set out above, and do not represent real or simulated data points.

FIG. 2 illustrates an example where the mass shift (delta m/z) changes with m/z, and in a non linear manner, across a range of different temperatures of the mr-TOF. In particular, four different curves are shown, representing plots of delta m/z vs m/z for different temperatures of the mr-TOF. A best fit algorithm has been employed to generate the curves labelled F1, F2, F3 and F4. These curves can be used to adjust the time of flight to m/z calibration function for different temperatures of the mr-TOF. In the example of FIG. 2, both the first and second derivatives of the curves are, for the sake of illustration, different for a given m/z at the different temperatures.

Although FIG. 2 indicates temperatures T1-T4, these are to explain the concept, rather than to represent the specific temperature of individual components. There are many factors that result in mechanical and electrical drift in the mr-TOF 150 over time and it is difficult to correlate the temperature of a specific component or components of the mr-TOF with a particular mass shift.

Thus, it is generally not considered desirable to obtain a set of time of flight to m/z calibration functions (for different temperatures) as part of the factory setup of the mass spectrometer 10, for all subsequent use. Such a method would then require the temperature of the mr-TOF to be measured and the appropriate predetermined calibration function to be applied to the mr-TOF, which, for the reasons given above, is difficult.

It is instead desirable that the method described above is carried out at regular intervals during the course of experiments, and a regularly updated calibration function is calculated "on the fly". For example, an initial calibration may be carried out prior to the commencement of experiments, using a known sample. This known sample may be introduced into the mass spectrometer 10, which produces a series of identifiable calibrant peaks across, preferably, the majority or all of the mass range that will be investigated during subsequent experiments. From that known sample, an initial calibration function may be obtained. Then, experiments may commence. For example, the arrangement of FIG. 1 is particularly suited to data independent analysis (DIA) and one technique that employs the FIG. 1 apparatus is described in EP17174365.1 filed on even date and entitled "Hybrid Mass Spectrometer".

The initial calibration function may be applied to the time of flight data obtained from the mr-TOF to convert those times of flight into m/z to form a mass spectrum. However, either after a predetermined period, or a predetermined number of experiments, for example, a new calibration function may be obtained, using the techniques described above, in order to generate a new calibration function that takes into account temperature drifts over the intervening period. As already noted, a suitable peak or peaks is chosen from those produced by the experimental sample(s) (and/or the background species accompanying the experimental sample(s) and is used to generate the subsequent modified calibration function.

Once the modified calibration function has been determined, subsequent time of flight data are converted into m/z using that instead. The process can be repeated until all experiments are complete, during which time further modified calibration functions may be obtained, to take into account ongoing temperature drifts.

(ii) Use of Both Precursor Ions and Fragment Ions

In the foregoing, the fragmentation chamber 120 is employed in ion guide mode with substantially no fragmentation of the precursor ions before they are injected into the mr-TOF. The calibration function is thus derived from two mass spectra that contain essentially the same data. Differences in the spectra can thus be ascribed to the temperature dependent effects on the mr-TOF mass spectrum.

However, most experiments carried out by the mass spectrometer 10 require fragmentation of the precursor ion species. For example, the DIA analysis described in the aforementioned EP17174365.1, filed on even date and entitled "Hybrid Mass Spectrometer", employs a workflow in which ions from a chromatographic peak are analysed as unfragmented precursor ion species in the FTMS 110 to produce an MS1 spectrum, whilst ions from the same chromatographic peak are then fragmented by the fragmentation chamber 120 and then subsequently accumulated (optionally) and analysed by the mr-TOF to produce an MS2 mass spectrum of the fragment ions. In such experiments, obtaining an MS1 mass spectrum from the mr-TOF by switching the fragmentation chamber 120 into ion guide mode—for the purposes of obtaining a temperature modified/compensated calibration function in accordance with the principles set out in (i) above—can increase total experiment time. Typically, a single precursor (MS1) scan is carried out at around 2 Hz using an Orbitrap® mass analyser with a resolving power around 240,000. The TOF MS may obtain up to 500 MS1 (or MS2) scans per second.

One alternative option, therefore, is to set the energy of the collision gas in the fragmentation chamber 120 such that some but not all of the precursor ions are fragmented. Then an MS2 mass spectrum can be obtained from the mr-TOF 150, whilst at least some precursor ion species are allowed into the mr-TOF for use as potential calibrant ions. As previously noted, peak shape and lack of interfering ion species/isotopes are desirable for a particular peak to be used as a calibrant peak.

The system controller 200 may accordingly be configured with logical instructions that take these considerations into account. For example, the system controller 200 may, at a predetermined time when a new calibration function is to be obtained, set the collision energy of the fragmentation chamber 120 at a first energy that results in a mixture of precursor and fragment ions in the mass spectrum generated by the mr-TOF. The FTMS and mr-TOF mass spectra are then compared to see if a sufficient number of peaks (which may be only a single peak) can be identified as suitable calibrant peaks. If yes, then a new calibration function is determined, and updated in memory for application to future mr-TOF mass spectra. If no, then the collision energy may be lowered to allow more precursor ion species to pass through the fragmentation chamber 120 without fragmentation. The analysis is then repeated until a satisfactory number of calibrant peaks is identified in each of the FTMS and mr-TOF mass spectra. This may, in some cases, require that the fragmentation energy is reduced to a point where the mr-TOF mass spectrum is essentially an MS1 spectrum with no, or no useful, fragment data contained in it.

(iii) Use of Fragment Ions Only

Still a further option for mr-TOF mass spectrum temperature correction employs only fragment ions. In this case, precursor ions from the ion source 20 are not trapped in the C-trap 100 for injection into the FTMS 110, but instead pass through the C-trap and into the fragmentation chamber 120 where they are fragmented. Some of the resulting fragment ions are then accumulated in the extraction trap for analysis by the mr-TOF 150, so that an MS2 scan is subsequently generated by the mr-TOF. Other fragment ions produced by the fragmentation chamber 120 are however returned back to the C-trap 100 where they are trapped and subsequently injected into the FTMS 110 so that the FTMS 110 also produces an MS2 spectrum. Then, a temperature compensated calibration function can be determined as before.

Such a technique can be beneficial where there is a significant dependence of mass shift upon mass number, since the masses of fragment ions are often significantly different (and, thus, subject to potentially significantly different mass shifts) than the precursor ions from which they derive.

The use of an MS2 spectrum or spectra has the advantage that interferences and chemical noise are minimised. That means that finding suitable peaks for cross calibration is simpler.

It is desirable to consider the absolute and relative resolving powers of the FTMS and mr-TOF mass analysers in the generation of effective calibration functions. For example, if the resolving power of the FTMS is, say, an order of magnitude greater than the resolving power of the TOF MS, it may become difficult successfully to identify suitable calibrant peaks, because those artefacts of the peaks identified in the FTMS mass spectrum may be missing (due to the lower resolving power) in the TOF MS mass spectrum. As of 2017, the typical resolving power of the mr-TOF may be up to high tens of thousands but of course higher resolving powers may be envisaged in future. Likewise the resolving power of the FTMS 110 is (in the case of the use of an Orbitrap®), currently at least 100,000 and up to several hundred thousand, with higher still resolving powers envisaged in future.

The specific resolving powers of the FTMS and TOF-MS are however not critical to the implementation of the invention. The shift in the time of flight of ions as the temperature changes in the TOF MS, has a much larger impact on the overall mass accuracy of the TOF MS, than other factors, under typical operating conditions. For example, the mass accuracy of an Orbitrap® is better than a few parts per million (eg +/−3 ppm or better) and is in any event independent of resolution. The mass accuracy of a TOF MS (setting aside for a moment the temperature dependence) is related to the resolution and the number of detected ions in a peak, but for a peak containing 100 ions, at 50-100K resolution, the mass accuracy is still around +/−3 ppm or better.

The effect of temperature drift is to introduce a mass accuracy (or more strictly an additional mass inaccuracy) on the order of some tens of ppm, over several hours. Thus it can clearly be seen that the relative resolutions of the FTMS and TOF MS will have a limited impact on the mass accuracy of the TOF MS, once the dominant effect of the temperature shifts on the TOF MS are taken into account.

All that is necessary is that at least one peak in the FTMS mass spectrum can be matched with a corresponding peak in the TOF MS mass spectrum, with an acceptable level of confidence. Clearly, when the resolving power of one of the FTMS and TOF MS devices differs significantly from the other, the peak shapes may be sufficiently different to make peak matching difficult. Selection of appropriate candidate peaks is accordingly desirable: in particular it is preferable to select an ion species which is substantially free from interferences. Multiple closely adjacent peaks may be visible in the FTMS mass spectrum (which is typically obtained at a relatively higher resolution) whereas only a single, broader, flatter peak is visible in the TOF MS mass spectrum obtained at a relatively lower resolution.

Figure 3A:
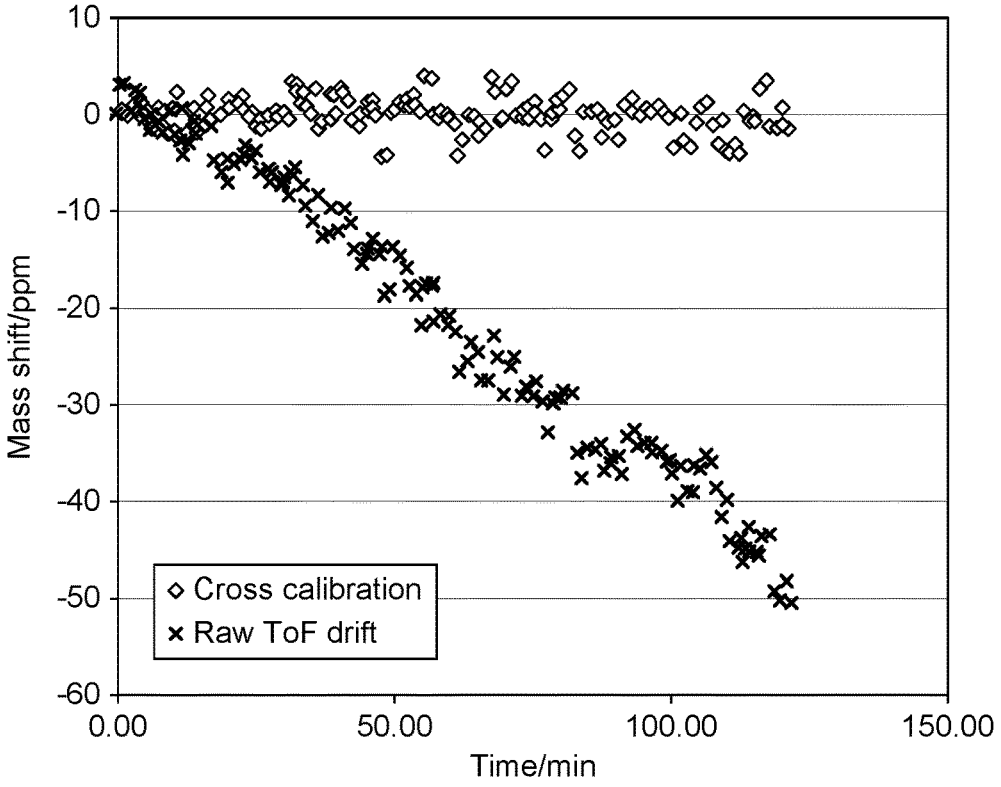
FIG. 3*a* shows a comparison of the shift in the measured mass in the TOF mass spectrum, before and after a correction for temperature variations has been applied.
Figure 3B:
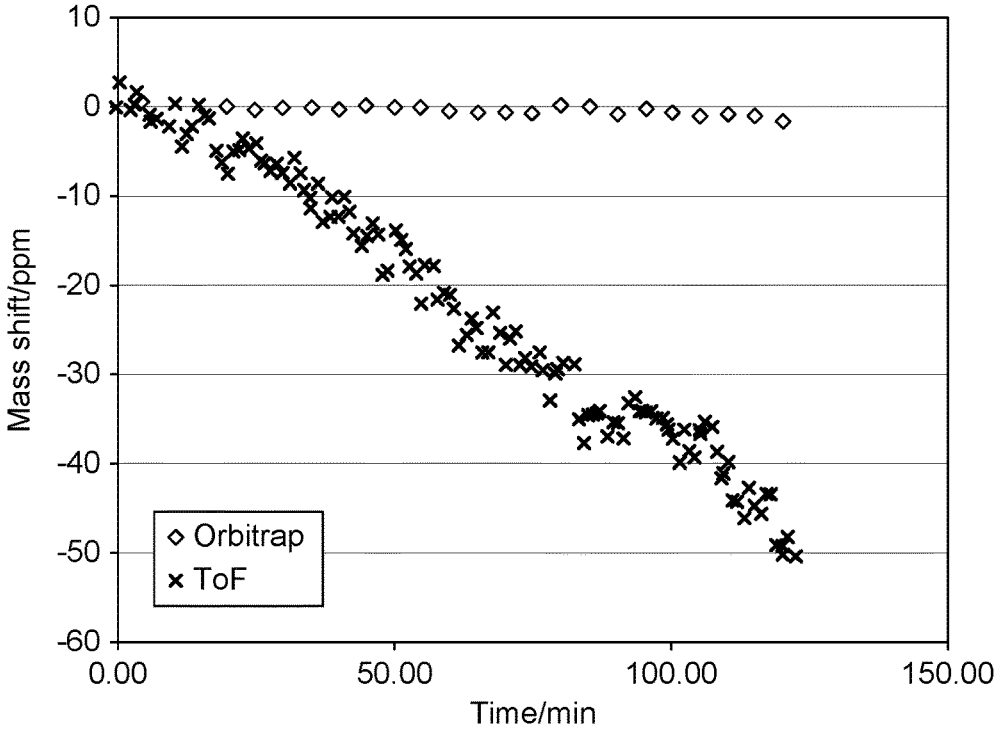
FIG. 3*b* shows a comparison of the shift in measured mass, with time, in the FTMS and TOF MS mass spectra respectively.

FIG. 3*b* shows a plot of mass shift (delta m/z) versus time (in minutes) for a single peak, generated by injecting ions of m/z 524 into an Orbitrap® (Diamond shaped data points) and the mr-TOF described previously (cross shaped data points). A TOF mass spectrum was obtained ever minute, whereas an Orbitrap® mass spectrum was obtained every 5 minutes. The vertical axis scale is parts per million. A clear and increasingly significant shift in the measured mass is seen in the TOF data points over a 2 hour (120 minute) period, whilst the mass shift in the peak in the Orbitrap® mass spectrum is more or less constant, at least at the ppm level, over that period.

FIG. 3*a* shows a plot of the uncorrected mass shift (delta m/z) versus time (in minutes) for the same single peak at m/z=524, as obtained from the TOF MS (data points are crosses). Also shown, however, is the TOF MS mass shift, following correction in accordance with the foregoing techniques (diamond data points). Although the standard deviation of the corrected mass shift data points is (as would be expected) higher than the standard deviation in the Orbitrap® mass shift data (FIG. 3*b*), nonetheless the systematic drift in the mass peak, shown by the slope of the uncorrected (raw) TOF MS data in FIG. 3*a*, has been largely eliminated.

Whilst a number of specific embodiments have been set out for the purposes of illustration only, it will of course be understood that various modifications and additions are possible. For example, the specific arrangement of components set out in FIG. 1 exemplifies a particularly preferred configuration to which the concepts set out herein can be applied. Nonetheless, a number of other arrangements may be envisaged. For example, the mr-TOF and FTMS devices may be reversed in the arrangement of FIG. 1, so that an intermediate trap (either a C-trap or otherwise) directs ions either into the mr-TOF or downstream, via a fragmentation chamber 120, to a C-trap for injection into an FTMS. Moreover, instead of a single fragmentation chamber 120 positioned between the C-trap and the mr-TOF, each mass analyser may instead have its own dedicated fragmentation chamber. This might simplify the procedure for obtaining MS2 scans from both the FTMS 110 and the mr-TOF 150, as described in method (iii) above.

Figure 4:
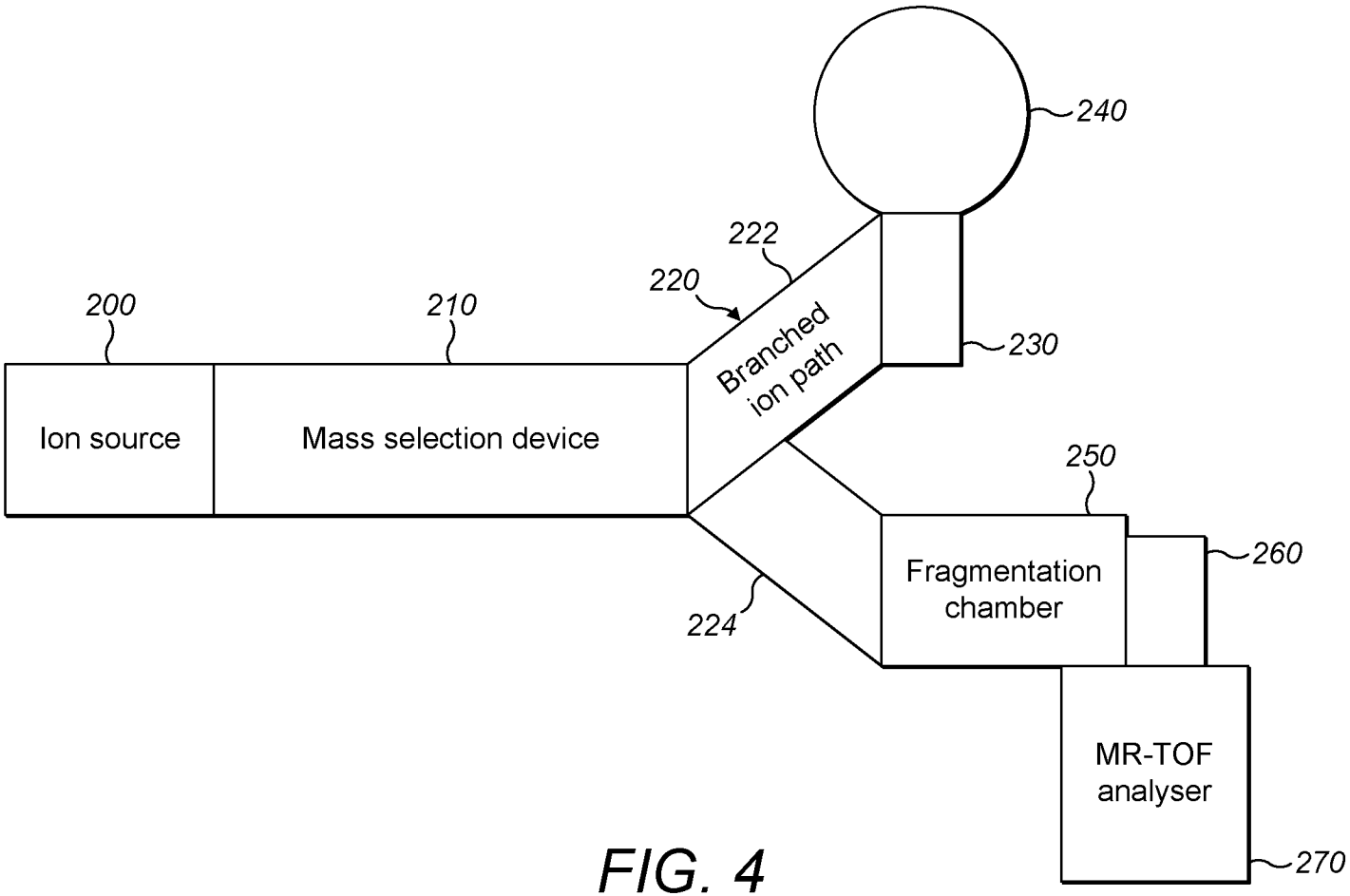
FIG. 4 shows a schematic layout of a mass spectrometer including a Fourier Transform Mass Analyser and a Time of Flight mass Analyser, and representing a second embodiment of the present invention.

FIG. 4 shows an alternative embodiment of a mass spectrometer suitable for implementation of the techniques of the present invention. The embodiment of the mass spectrometer of FIG. 4 employs a branched path arrangement.

In the embodiment of FIG. 4, an ion source 200 is coupled to a mass selection device 210. Such an arrangement may be provided by the ESI ion source 20 and its respective couplings to the quadrupole mass filter 70 as shown in the embodiment of FIG. 1 for example.

As shown in FIG. 4, the output of the mass selection device 210 is coupled to the branched ion path 220. The branched ion path directs ions output from the mass selection device along one of two paths. A first path 222 directs ions to a C-trap 230 where ions are collected for analysis by an FTMS analyser 240 (typically, to capture precursor MS1 data as discussed above in connection with FIG. 1). A second path 224 directs ions to a fragmentation chamber 250. Here they may be partially fragmented (see (ii) above) or completely fragmented (see (iii) above) or the energy of the fragmentation chamber 250 may be set so that ions pass through substantially without fragmentation for subsequent mass analysis via an mr-TOF analyser 270 (example (i) above). The branched ion path may use an rf voltage to direction ions down either the first path 222 or the second path 224. The branched ion path may be a branched RF multipole. A branched ion path suitable for use in the embodiment of FIG. 4 is further described in U.S. Pat. No. 7,420,161.

According to the alternative embodiment in FIG. 4, the branched ion path may be used to direct ions to a C-trap 230 for analysis by the FTMS analyser 240 or to an mr-TOF analyser 260 for TOF analysis, via a fragmentation chamber 250 operable in fragmentation or ion guide modes. Precursor or fragment ions ejected from the fragmentation chamber 250 may be accumulated in ion extraction trap 260, before being injected into the mr-TOF analyser 270 as a packet. As such, the arrangement of the fragmentation chamber 250, ion trap 260 and mr-TOF 270 may be provided by a similar arrangement as described in FIG. 1.

Thus, according to the alternative embodiment in FIG. 4, ions may be directed for analysis by the mr-TOF analyser 270 without requiring the C-trap 230 supplying the FTMS analyser 240 to be empty. Such a configuration may allow increased parallelisation of the FTMS and mr-TOF scans. As such, a greater proportion of the duration of a chromatographic peak may be available for carrying out mr-TOF scans. Furthermore, in this configuration, a number of loadings or fills can be accumulated in the C-trap before analysis in the FTMS 240. In such embodiments, the loading of the C-trap can be split into several small fills whilst the FTMS analyser is scanning, thereby to obtain a population of ions that is more representative of the ions from across the entire peak.

The techniques for temperature correction of the position of mass peaks in the mr-TOF data are otherwise as described above in connection with FIGS. 1, 2 and 3.

The foregoing proposes selecting candidate calibrant peaks in the FTMS mass spectrum, and then matching them in the mr-TOF mass spectrum. Because the resolving power of the FTMS is generally higher than that of the TOF, the likelihood of matching the wrong peaks is reduced. Nevertheless, the invention is not so limited, and it is possible to obtain a temperature corrected calibration function by selecting a candidate peak or peaks in the TOF mass spectrum and then locating corresponding peaks in the FTMS mass spectrum, with the calibration function being derived from that comparison.

Moreover, it is not necessary to apply the temperature correction to the time of flight to m/z calibration function (so as to generate a temperature corrected calibration function). Instead the calibration function determined at the start of experiments may be employed throughout without subsequent modification. Then, the mass spectrum (specifically, the m/z data)—rather than the raw time of flight data—can be corrected using a temperature correction factor which adjusts the m/z of each peak in the mass spectrum based upon the position of that or those peaks in the FTMS mass spectrum.

The invention claimed is:

1. A method of calibrating a TOF-MS mass spectrum, to account for temperature changes, comprising:

(a) introducing ions into a Fourier Transform Mass Spectrometer (FTMS);

(b) obtaining data representative of the mass to charge ratios of at least some calibrant ions of the ions introduced into the FTMS (c) introducing ions into a time of flight mass spectrometer (TOF MS), the ions introduced into the TOF MS including ions from the calibrant ion species;

(d) obtaining data representative of the mass to charge ratio of at least the ions of the calibrant ion species introduced into the TOF MS;

(e) choosing one or more peaks in the data obtained from a first of the FTMS and the TOF MS, representative of one or more calibrant ion species;

(f) matching the or each chosen peak in the data obtained from the first of the FTMS and the TOF MS, with a corresponding one or more peaks in the data obtained from the second of the FTMS and the TOF MS and representative of the or each chosen calibrant ion species;

(g) determining a temperature correction factor for the TOF MS data, based upon a relative position of the TOF MS and FTMS calibrant ion species peaks; and (h) applying the said temperature correction factor to data obtained by the TOF MS in order to correct the said TOF MS data for changes in temperature of the TOF MS.

2. The method of claim 1, wherein the step (h) further comprises applying the said temperature correction factor to one or more subsequent data sets obtained from the TOF MS.

3. The method of claim 1, wherein the data obtained from the TOF MS is time of flight data, the method further comprising determining a first calibration function to be applied to the TOF MS time of flight data in order to convert it into a mass spectrum, and further wherein the step (g) of determining the temperature correction factor for the TOF MS data comprises determining a modified first calibration function to be applied to the TOF MS time of flight data in order to convert it into a mass spectrum which is corrected for the said change in temperature of the TOF MS.

4. The method of claim 1, wherein the step (e) comprises choosing one or more peaks in the data obtained from the FTMS, wherein the step (f) comprises matching a corresponding one or more peaks in the data obtained from the TOF MS representative of the or each chosen calibrant ion species, and wherein the step (g) comprises determining a temperature correction factor from the shift in the position of the or each calibrant peak in the TOF MS data relative to the position of the or each corresponding calibrant peak in the FTMS data.

5. The method of claim 1, wherein the step (a) comprises introducing precursor ions into the FTMS from at least one calibrant ion species, and wherein the step (c) comprises introducing precursor ions into the TOF MS from that at least one calibrant ion species.

6. The method of claim 5, further comprising fragmenting the precursor ions of the calibrant ion species under conditions such that some but not all of the ions of that calibrant ion species are fragmented, the step (a) and/or the step (c) comprising introducing both the fragment ions derived from the precursor ions and also the unfragmented precursor ions of the said calibrant ion species into the TOF MS, the step (e) comprising choosing one or more peaks in the TOF MS or FTMS data representative of the, or at least one of the, unfragmented precursor ion species.

7. The method of claim 1, further comprising subsequently repeating steps (a) to (g) so as to determine an updated temperature correction factor.

8. The method of claim 7, wherein the repetition of steps (a) to (g) is carried out at a plurality of predetermined time intervals.

9. The method of claim 1, wherein the calibrant ion species has a mass peak which is a single resolved peak in the FTMS.

10. The method of claim 1, wherein the step of choosing one or more peaks in the FTMS and TOF MS data comprises selecting a corresponding group of peaks in each of said FTMS and TOF MS data.

11. The method of claim 1, further comprising, prior to the step (c) of introducing ions into the TOF-MS, the step of accumulating ions of the said calibrant ion species in an ion trap, the step (c) then comprising introducing the accumulated ions from the ion trap into the TOF MS.

12. The method of claim 1, in which the step (a) comprises introducing ions into an orbital trapping mass spectrometer.

13. The method of claim 1, in which the step (c) comprises introducing ions into a multi reflection time of flight mass spectrometer (MR-TOF MS).

14. A system for calibrating a TOF-MS mass spectrum, to account for temperature changes, comprising:

(i) an ion source, arranged to generate ions;

(j) a Fourier Transform Mass Spectrometer (FTMS) for analysing ions introduced into it, and generating data representative of the mass to charge ratios of those ions, (k) a Time of Flight Mass spectrometer, (TOF MS) for analysing ions introduced into it and generating data representative of the mass to charge ratios of those ions, and (l) a system controller, arranged to i. choose one or more peaks in a first of the FTMS and the TOF MS data, representative of one or more calibrant ion species introduced to the first of the FTMS and the TOF MS respectively;

ii. match the or each chosen peak in the data obtained from the first of the FTMS and the TOF MS, with a corresponding one or more peaks in the data obtained from a second of the FTMS and the TOF MS and representative of the or each chosen calibrant ion species;

iii. determine a temperature correction factor for the TOF MS data based upon a relative position of the TOF MS and FTMS calibrant ion species peaks; and iv. apply the said temperature correction factor to data obtained by the TOF MS in order to correct the said TOF MS data for changes in temperature of the TOF MS.

15. The system of claim 14, further comprising the ion trapping means positioned so as to receive ions from the ion source and so as subsequently to introduce the ions directly or indirectly into the FTMS and the TOF MS.

16. The apparatus of claim 15, wherein the ion trapping means comprises a first ion trap configured to capture ions from the ion source and introduce them into the FTMS, and a second ion trap, separate from the first ion trap and configured to capture ions from the ion source and introduce them into the TOF MS.

17. The system of claim 16, wherein the FTMS is an orbital trapping mass spectrometer, and the first ion trap is a curved ion trap (C-trap) arranged to receive and trap ions from the ion source generally along a first axis and to eject them from the C-trap towards the orbital trapping mass spectrometer in a direction generally perpendicular with the first axis.

18. The system of claim 14, further comprising a fragmentation chamber positioned upstream of the TOF MS, for receiving precursor ions from the ion source and optionally fragmenting some but not all of the precursor ions of the calibrant ion species prior to their introduction into the TOF MS.

19. The system of claim 18, wherein the fragmentation chamber is positioned between the first ion trap and the second ion trap.

20. The system of claim 19, wherein the system controller is configured, during a first time period, to control the C-trap so as to capture ions from the ion source therein, and subsequently eject them orthogonally to the orbital trapping mass spectrometer, and during a second time period, to control the C-trap so that ions arriving from the ion source pass through the C-trap and on to the fragmentation chamber without being captured by the C-trap.

21. The system of claim 14, wherein the TOF MS is a multi reflection Time of Flight mass spectrometer (MR TOF MS).

* * * * *